US006053008A

United States Patent [19]

Arman et al.

[11] Patent Number: 6,053,008

[45] Date of Patent: Apr. 25, 2000

[54] METHOD FOR CARRYING OUT SUBAMBIENT TEMPERATURE, ESPECIALLY CRYOGENIC, SEPARATION USING REFRIGERATION FROM A MULTICOMPONENT REFRIGERANT FLUID

[75] Inventors: Bayram Arman; Dante Patrick Bonaquist, both of Grand Island; Joseph Alfred Weber, Cheektowaga; Mark Edward Vincett, Lancaster, all of N.Y.

[73] Assignee: Praxair Technology, Inc., Danbury, Conn.

[21] Appl. No.: 09/222,816

[22] Filed: Dec. 30, 1998

[51] Int. Cl.[7] ..... F25J 3/00

[52] U.S. Cl. ..... 62/646; 62/940

[58] Field of Search ..... 62/643, 646, 940

[56] References Cited

U.S. PATENT DOCUMENTS 4,303,428 12/1981 Vandenbussche ..... 62/13
4,375,367 3/1983 Prentice ..... 62/13
4,407,135 10/1983 Pahade ..... 62/13
5,237,822 8/1993 Rathbone ..... 62/25
5,287,704 2/1994 Rathbone ..... 62/25
5,329,776 7/1994 Grenier ..... 62/940
5,438,835 8/1995 Rathbone ..... 62/646
5,441,658 8/1995 Boyarsky et al. ..... 252/67
5,475,980 12/1995 Grenier et al. ..... 62/940
5,511,381 4/1996 Higginbotham ..... 62/646
5,579,654 12/1996 Longsworth et al. ..... 62/511

*Primary Examiner*—Ronald Capossela
*Attorney, Agent, or Firm*—Stanley Ktorides

[57] ABSTRACT

A method for low temperature separation of fluids wherein the separation process is sustained by refrigeration generated by a recirculating multicomponent refrigerant fluid.

15 Claims, 1 Drawing Sheet

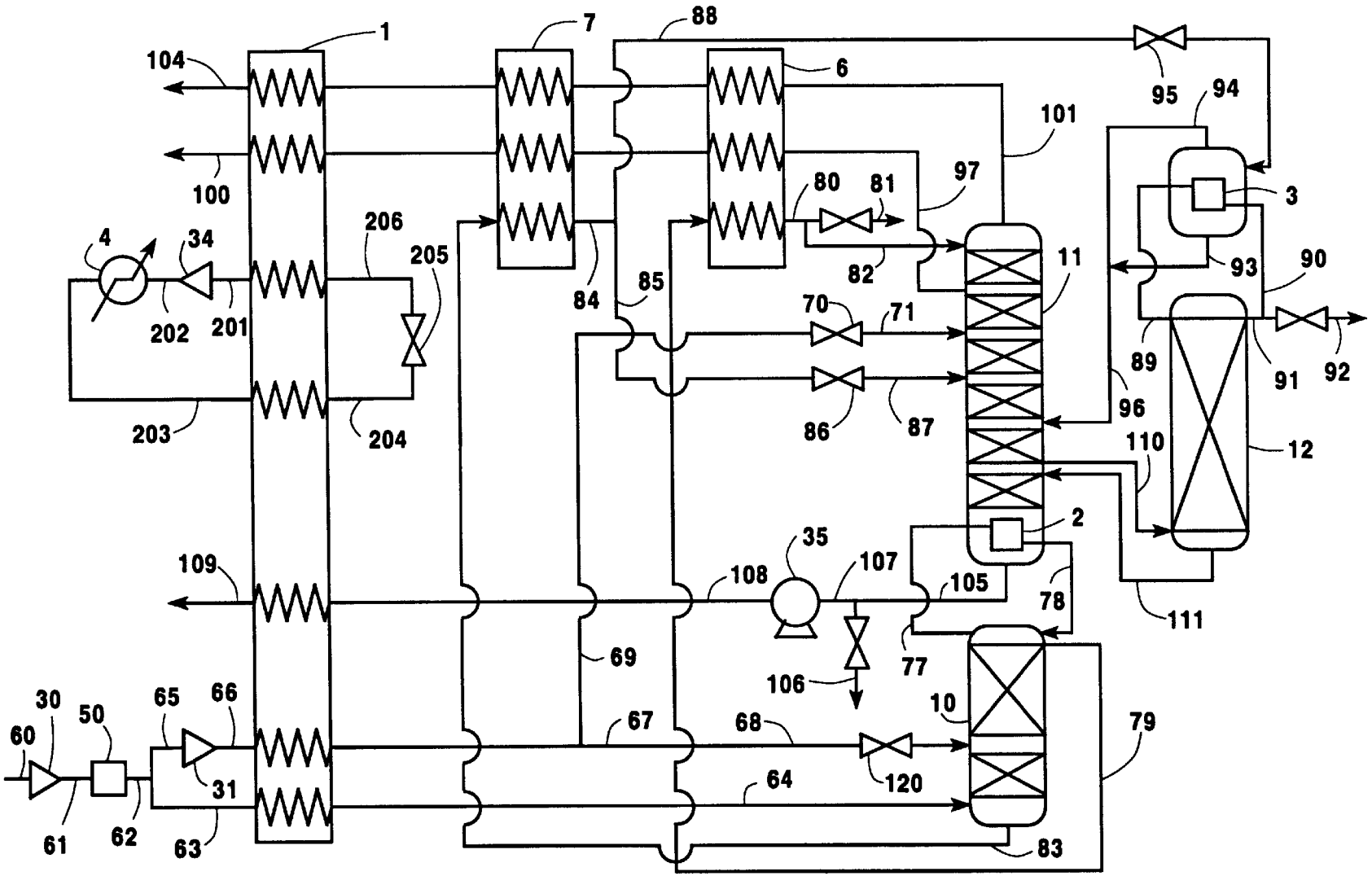
92
90
91
12
3
93
94
95
89
96
110
111
79
101
11
2
78
83
97
105
10
77
120
81
82
71
87
107
106
6
80
70
86
35
68
64
108
88
85
69
67
7
84
205
206
204
1
104
100
201
34
202
203
109
66
31
63
65
62
4
50
30
61
60

METHOD FOR CARRYING OUT SUBAMBIENT TEMPERATURE, ESPECIALLY CRYOGENIC, SEPARATION USING REFRIGERATION FROM A MULTICOMPONENT REFRIGERANT FLUID

TECHNICAL FIELD

This invention relates generally to providing refrigeration for subambient temperature separation of mixtures, and is particularly advantageous for use with cryogenic separation.

BACKGROUND

In subambient temperature separations, refrigeration is provided to a gas mixture to maintain the low temperature conditions and thus facilitate the separation of the mixture into its components for recovery. Examples of such subambient temperature separations include cryogenic air separation, natural gas upgrading, hydrogen recovery from raw syngas, and carbon dioxide production. One way for providing the requisite refrigeration to carry out the separation is by turboexpanding a fluid stream and using the refrigeration generated by the turboexpansion, either directly or by indirect heat exchange, to facilitate the separation. Such a system, while effective, uses significant amounts of energy and can reduce product recovery and is thus costly to operate.

Refrigeration can also be generated using a refrigeration circuit wherein a refrigerant fluid is compressed and liquefied and then undergoes a phase change at a given temperature from a liquid to a gas thus making its latent heat of vaporization available for cooling purposes. Such refrigeration circuits are commonly used in home refrigerators and air conditioners. While such a refrigeration circuit is effective for providing refrigeration at a given temperature and at relatively high subambient temperatures, it is not very efficient when refrigeration at low temperatures and over a relatively wide temperature range is desired.

Accordingly it is an object of this invention to provide a method for carrying out a subambient temperature separation of a fluid mixture, especially one carried out at cryogenic temperatures, more efficiently than with conventional separation systems and without the need for using turboexpansion to generate any of the requisite refrigeration for the separation.

SUMMARY OF THE INVENTION

The above and other objects which will become apparent to one skilled in the art upon a reading of this disclosure are attained by the present invention, one aspect of which is:

A method for separating a fluid mixture comprising:

(A) compressing a multicomponent refrigerant fluid;

(B) cooling the compressed multicomponent refrigerant fluid to at least partially condense the multicomponent refrigerant fluid;

(C) expanding the cooled, compressed multicomponent refrigerant fluid to generate refrigeration;

(D) employing said refrigeration to maintain low temperature conditions for a fluid mixture;

(E) separating the fluid mixture into at least one more volatile vapor component and into at least one less volatile liquid component; and (F) recovering at least one of said more volatile vapor component(s) and less volatile liquid component(s).

Another aspect of the invention is:

A method for carrying out cryogenic rectification of feed air comprising:

(A) passing feed air into a cryogenic rectification plant and separating the feed air by cryogenic rectification within the cryogenic rectification plant to produce at least one of product nitrogen and product oxygen;

(B) compressing a multicomponent refrigerant fluid, cooling the compressed multicomponent refrigerant fluid to at least partially condense the multicomponent refrigerant fluid, expanding the cooled, compressed multicomponent refrigerant fluid to generate refrigeration, and employing said refrigeration to sustain said cryogenic rectification; and (C) recovering at least one of product nitrogen and product oxygen from the cryogenic rectification plant.

As used herein the term "refrigeration" means the capability to reject heat from a subambient temperature system, such as a subambient temperature separation process, to the surrounding atmosphere.

As used herein the term "cryogenic rectification plant" means a facility for fractionally distilling a mixture by cryogenic rectification, comprising one or more columns and the piping, valving and heat exchange equipment attendant thereto.

As used herein, the term "feed air" means a mixture comprising primarily oxygen, nitrogen and argon, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component (s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K.).

As used herein, the term "indirect heat exchange" means the bringing of two fluid streams into heat exchange relation without any physical contact or intermixing of the fluids with each other.

As used herein, the terms "turboexpansion" and "turboexpander" mean respectively method and apparatus for the flow of high pressure fluid through a turbine to reduce the pressure and the temperature of the fluid thereby generating refrigeration.

As used herein the term "expansion" means to effect a reduction in pressure.

As used herein the term "product nitrogen" means a fluid having a nitrogen concentration of at least 99 mole percent.

As used herein the term "product oxygen" means a fluid having an oxygen concentration of at least 70 mole percent.

As used herein the term "variable load refrigerant" means a mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the practice of this invention the temperature differences between the bubble point and the dew point for the variable load refrigerant is at least 10° K., preferably at least 20° K. and most preferably at least 50° K.

As used herein the term "fluorocarbon" means one of the following: tetrafluoromethane ($CF_4$), perfluoroethane ($C_2F_6$), perfluoropropane ($C_3F_8$), perfluorobutane ($C_4F_{10}$), perfluoropentane ($C_5F_{12}$), perfluoroethene ($C_2F_4$), perfluoropropene ($C_3F_6$), perfluorobutene ($C_4F_8$), perfluoropentene ($C_5F_{10}$), hexafluorocyclopropane (cyclo-$C_3F_6$) and octafluorocyclobutane (cyclo-$C_4F_8$).

As used herein the term "hydrofluorocarbon" means one of the following: fluoroform ($CHF_3$), pentafluoroethane ($C_2HF_5$), tetrafluoroethane ($C_2H_2F_4$), heptafluoropropane ($C_3HF_7$), hexafluoropropane ($C_3H_2F_6$), pentafluoropropane ($C_3H_3F_5$), tetrafluoropropane ($C_3H_4F_4$), nonafluorobutane ($C_4HF_9$), octafluorobutane ($C_4H_2F_8$), undecafluoropentane ($C_5HF_{11}$), methyl fluoride ($CH_3F$), difluoromethane ($CH_2F_2$), ethyl fluoride ($C_2H_5F$), difluoroethane ($C_2H_4F_2$), trifluoroethane ($C_2H_3F_3$), difluoroethene ($C_2H_2F_2$), trifluoroethene ($C_2HF_3$), fluoroethene ($C_2H_3F$), pentafluoropropene ($C_3HF_5$), tetrafluoropropene ($C_3H_2F_4$), trifluoropropene ($C_3H_3F_3$), difluoropropene ($C_3H_4F_2$), heptafluorobutene ($C_4HF_7$), hexafluorobutene ($C_4H_2F_6$) and nonafluoropentene ($C_5HF_9$).

As used herein the term "fluoroether" means one of the following: trifluoromethyoxy-perfluoromethane ($CF_3$—O—$CF_3$), difluoromethoxy-perfluoromethane ($CHF_2$—O—$CF_3$), fluoromethoxy-perfluoromethane ($CH_2F$—O—$CF_3$), difluoromethoxy-difluoromethane ($CHF_2$—O—$CHF_2$), difluoromethoxy-perfluoroethane ($CHF_2$—O—$C_2F_5$), difluoromethoxy-1,2,2,2-tetrafluoroethane ($CHF_2$—O—$C_2HF_4$), difluoromethoxy-1,1,2,2-tetrafluoroethane ($CHF_2$—O—$C_2HF_4$), perfluoroethoxy-fluoromethane ($C_2F_5$—O—$CH_2F$), perfluoromethoxy-1,1,2-trifluoroethane ($CF_3$—O—$C_2H_2F_3$), perfluoromethoxy-1,2,2-trifluoroethane ($CF_3O$—$C_2H_2F_3$), cyclo-1,1,2,2-tetrafluoropropylether (cyclo-$C_3H_2F_4$—O—), cyclo-1,1,3,3-tetrafluoropropylether (cyclo-$C_3H_2F_4$—O—), perfluoromethoxy-1,1,2,2-tetrafluoroethane ($CF_3$—O—$C_2HF_4$), cyclo-1,1,2,3,3-pentafluoropropylether (cyclo-$C_3H_5$—O—), perfluoromethoxy-perfluoroacetone ($CF_3$—O—$CF_2$—O—$CF_3$), perfluoromethoxy-perfluoroethane ($CF_3$—O—$C_2F_5$), perfluoromethoxy-1,2,2,2-tetrafluoroethane ($CF_3$—O—$C_2HF_4$), perfluoromethoxy-2,2,2-trifluoroethane ($CF_3$—O—$C_2H_2F_3$), cyclo-perfluoromethoxy-perfluoroacetone (cyclo-$CF_2$—O—$CF_2$—O—$CF_2$—) and cyclo-perfluoropropylether (cyclo-$C_3F_6$—O).

As used herein the term "atmospheric gas" means one of the following: nitrogen ($N_2$), argon (Ar), krypton (Kr), xenon (Xe), neon (Ne), carbon dioxide ($CO_2$), oxygen ($O_2$) and helium (He).

As used herein the term "non-toxic" means not posing an acute or chronic hazard when handled in accordance with acceptable exposure limits.

As used herein the term "non-flammable" means either having no flash point or a very high flash point of at least 600° K.

As used herein the term "low-ozone-depleting" means having an ozone depleting potential less than 0.15 as defined by the Montreal Protocol convention wherein dichlorofluoromethane ($CCl_2F_2$) has an ozone depleting potential of 1.0.

As used herein the term "non-ozone-depleting" means having no component which contains a chlorine, bromine or iodine atom.

As used herein the term "normal boiling point" means the boiling temperature at 1 standard atmosphere pressure, i.e. 14.696 pounds per square inch absolute.

BRIEF DESCRIPTION OF THE DRAWINGS

The sole FIGURE is a schematic representation of one preferred embodiment of the invention wherein the separation is cryogenic air separation and a multicomponent refrigerant fluid refrigeration circuit serves to generate refrigeration to cool and thereby maintain the low temperatures within the cryogenic air separation plant.

DETAILED DESCRIPTION

The invention will be described in detail with reference to the Drawing. In the FIGURE there is illustrated a cryogenic air separation plant having three columns, a double column having higher and lower pressure columns, and an argon sidearm column.

Referring now to the FIGURE, feed air 60 is compressed by passage through base load compressor 30 to a pressure generally within the range of from 35 to 250 pounds per square inch absolute (psia). Resulting compressed feed air 61 is cooled of the heat of compression in an aftercooler (not shown) and is then cleaned of high boiling impurities such as water vapor, carbon dioxide and hydrocarbons by passage through purifier 50 and then purified feed air stream 62 is divided into two portions designated 65 and 63. Portion 65, generally comprising from 20 to 35 percent of feed air stream 62, is further compressed by passage through booster compressor 31 to a higher pressure, which may be up to 1000 psia. Resulting further compressed feed air stream 66 is cooled of the heat of compression in an aftercooler (not shown) and is cooled and at least partially condensed by indirect heat exchange in main or primary heat exchanger 1 with return streams. Resulting cooled feed air stream 67 is then divided into stream 68 which is passed into higher pressure column 10 through valve 120 and into stream 69 which is passed through valve 70 and as stream 71 into lower pressure column 11.

The remaining portion 63 of feed air stream 62 is cooled by passage through main heat exchanger 1 by indirect heat exchange with return streams and passed as stream 64 into higher pressure column 10 which is operating at a pressure generally within the range of from 35 to 250 psia. Within higher pressure column 10 the feed air is separated by cryogenic rectification into nitrogen-enriched vapor and oxygen-enriched liquid. Nitrogen-enriched vapor is withdrawn from the upper portion of higher pressure column 10 in stream 77 and condensed in reboiler 2 by indirect heat exchange with boiling lower pressure column bottom liquid. Resulting nitrogen-enriched liquid 78 is returned to column 10 as reflux. A portion of the nitrogen-enriched liquid 79 is passed from column 10 to desuperheater 6 wherein it is subcooled to form subcooled stream 80. If desired, a portion 81 of stream 80 may be recovered as product liquid nitrogen having a nitrogen concentration of at least 99 mole percent. The remainder of stream 80 is passed in stream 82 into the upper portion of column 11 as reflux.

Oxygen-enriched liquid is withdrawn from the lower portion of higher pressure column 10 in stream 83 and passed to desuperheater 7 wherein it is subcooled. Resulting subcooled oxygen-enriched liquid 84 is then divided into portion 85 and portion 88. Portion 85 is passed through valve 86 and as stream 87 into lower pressure column 11. Portion 88 is passed through valve 95 into argon column condenser 3 wherein it is partially vaporized. The resulting vapor is withdrawn from condenser 3 in stream 94 and passed into lower pressure column 11. Remaining oxygen-enriched liquid is withdrawn from condenser 3 in stream 93, combined with stream 94 to form stream 96 and then passed into lower pressure column 11.

Lower pressure column 11 is operating at a pressure less than that of higher pressure column 10 and generally within the range of from 15 to 100 psia. Within lower pressure column 11 the various feeds are separated by cryogenic rectification into nitrogen-rich vapor and oxygen-rich liquid. Nitrogen-rich vapor is withdrawn from the upper portion of column 11 in stream 101, warmed by passage through heat exchangers 6, 7 and 1, and recovered as product nitrogen in stream 104 having a nitrogen concentration of at least 99 mole percent, preferably at least 99.9 mole percent, and most preferably at least 99.999 mole percent. For product purity control purposes a waste stream 97 is withdrawn from column 11 from a level below the withdrawal point of stream 101, warmed by passage through heat exchangers 6, 7 and 1, and removed from the system in stream 100. oxygen-rich liquid is withdrawn from the lower portion of column 11 in stream 105 having an oxygen concentration generally within the range of from 90 to 99.9 mole percent. If desired a portion 106 of stream 105 may be recovered, as product liquid oxygen. The remaining portion 107 of stream 105 is pumped to a higher pressure by passage through liquid pump 35 and pressurized stream 108 is vaporized in main heat exchanger 1 and recovered as product elevated pressure oxygen gas 109.

Fluid comprising oxygen and argon is passed in stream 110 from lower pressure column 11 into argon column 12 wherein it is separated by cryogenic rectification into argon-richer fluid and oxygen-richer fluid. Oxygen-richer fluid is passed from the lower portion of column 12 in stream 111 into lower pressure column 11. Argon-richer fluid is passed from the upper portion of column 12 in vapor stream 89 into argon column condenser 3 wherein it is condensed by indirect heat exchange with the aforesaid partially vaporizing subcooled oxygen-enriched liquid. Resulting argon-richer liquid is withdrawn from condenser 3 in stream 90. A portion 91 is passed into argon column 12 as reflux and another portion 92 is recovered as product argon having an argon concentration generally within the range of from 95 to 99.9 mole percent.

There will now be described in greater detail the operation of the multicomponent refrigerant fluid circuit which serves to generate all the refrigeration passed into the cryogenic rectification plant thereby eliminating the need for any turboexpansion of a process stream to produce refrigeration for the separation.

Subambient temperature separation processes require refrigeration for several purposes. First, since the process equipment operates at low temperatures, there is heat leakage from the ambient atmosphere into the equipment that is a function of the equipment surface areas, the local operating temperature, and the equipment insulation. Second, since the processes generally involve heat exchange between feed and return streams, there is net heat input into the process associated with the temperature differences for the heat exchange. Third, if the process produces liquid product from gaseous feed, sufficient refrigeration must be provided for the liquefaction. Fourth, for those processes that utilize pumping of cold fluids, such as liquid pumping, the pumping energy must be rejected from the process system. Fifth, for those processes that utilize liquid pumping and vaporization to provide high pressure gas product, commonly referred to as product boiler processes, heat pumping is required between the two temperature levels associated with the liquid vaporization at the low and elevated pressure levels. Such heat pumping is often provided by a fraction of the feed air at an elevated pressure level, but can be supplemented by external system refrigeration. Finally, there may be other miscellaneous heat input or refrigeration needs for the process.

Satisfactory operation of the subambient temperature separation process requires sufficient refrigeration to compensate for all heat input to the system and thereby maintenance of the low temperatures associated with the process. As can be envisioned from the diverse refrigeration requirements enumerated above, the typical subambient temperature separation process has a variable refrigeration requirement over the entire temperature range associated with the separation, i.e. from the ambient temperature to the coldest temperature within the separation process. Generally the heat exchangers utilized to cool the feed streams versus returning streams will include the entire temperature range associated with the separation process. Hence that exchanger is suitable for providing the required refrigeration. The multicomponent refrigerant fluid can be incorporated into that heat exchanger to provide the variable refrigeration over the entire temperature range. The provision of the variable refrigeration, as needed at each temperature, allows the matching of the composite heat exchanger cooling and warming curves and thereby reduces separation process energy requirements. Such equating of required and supplied refrigeration at all temperature levels within the heat exchanger allows the heat exchanger to operate at uniform or approximately uniform temperature differences throughout its entire length. Although the above-described situation is the preferred practice for the invention, it is understood that some deviation may be allowed for acceptable practice. For example, it is well known that the cooling and warming curve matching is more important at lower temperatures. Hence, an acceptable system could have closer curve matching below 200° K. than in the 200° K. to 300° K. temperature region. Also, although it is preferred to incorporate the multicomponent refrigerant circuit throughout the entire length of the heat exchanger, it may be acceptable to include the refrigerant circuit within only a portion of the heat exchanger length.

The following description illustrates the multicomponent refrigerant fluid system for providing refrigeration throughout the primary heat exchanger 1. Multicomponent refrigerant fluid in stream 201 is compressed by passage through recycle compressor 34 to a pressure generally within the range of from 60 to 600 psia to produce compressed refrigerant fluid 202. The compressed refrigerant fluid is cooled of the heat of compression by passage through aftercooler 4 and may be partially condensed. The multicomponent refrigerant fluid in stream 203 is then passed through heat exchanger 1 wherein it is further cooled and is at least partially condensed and may be completely condensed. The cooled, compressed multicomponent refrigerant fluid 204 is then expanded or throttled though valve 205. The throttling preferably partially vaporizes the multicomponent refrigerant fluid, cooling the fluid and generating refrigeration. For some limited circumstances, dependent on heat exchanger conditions, the compressed fluid 204 may be subcooled liquid prior to expansion and may remain as liquid upon initial expansion. Subsequently, upon warming in the heat exchanger, the fluid will have two phases. The pressure expansion of the fluid through a valve would provide refrigeration by the Joule-Thomson effect, i.e. lowering of the fluid temperature due to pressure expansion at constant enthalpy. However, under some circumstances, the fluid expansion could occur by utilizing a two-phase or liquid expansion turbine, so that the fluid temperature would be lowered due to work expansion.

Refrigeration bearing multicomponent two phase refrigerant fluid stream 206 is then passed through heat exchanger 1 wherein it is warmed and completely vaporized thus serving by indirect heat exchange to cool stream 203 and also to transfer refrigeration into the process streams within the heat exchanger, including feed air streams 66 and 63, thus passing refrigeration generated by the multicomponent refrigerant fluid refrigeration circuit into the cryogenic rectification plant to sustain the separation process. The resulting warmed multicomponent refrigerant fluid in vapor stream 201 is then recycled to compressor 34 and the refrigeration cycle starts anew. In the multicomponent refrigerant fluid refrigeration cycle while the high pressure mixture is condensing, the low pressure mixture is boiling against it, i.e. the heat of condensation boils the low-pressure liquid. At each temperature level, the net difference between the vaporization and the condensation provides the refrigeration. For a given refrigerant component combination, mixture composition, flowrate and pressure levels determine the available refrigeration at each temperature level.

The multicomponent refrigerant fluid contains two or more components in order to provide the required refrigeration at each temperature. The choice of refrigerant components will depend on the refrigeration load versus temperature for the particular process application. Suitable components will be chosen depending upon their normal boiling points, latent heat, and flammability, toxicity, and ozone-depletion potential.

One preferable embodiment of the multicomponent refrigerant fluid useful in the practice of this invention comprises at least two components from the group consisting of fluorocarbons, hydrofluorocarbons and fluoroethers.

Another preferable embodiment of the multicomponent refrigerant fluid useful in the practice of this invention comprises at least one component from the group consisting of fluorocarbons, hydrofluorocarbons and fluoroethers, and at least one atmospheric gas.

Another preferable embodiment of the multicomponent refrigerant fluid useful in the practice of this invention comprises at least two components from the group consisting of fluorocarbons, hydrofluorocarbons and fluoroethers, and at least two atmospheric gases.

Another preferable embodiment of the multicomponent refrigerant fluid useful in the practice of this invention comprises at least one fluoroether and at least one component from the group consisting of fluorocarbons, hydrofluorocarbons, fluoroethers and atmospheric gases.

In one preferred embodiment the multicomponent refrigerant fluid consists solely of fluorocarbons. In another preferred embodiment the multicomponent refrigerant fluid consists solely of fluorocarbons and hydrofluorocarbons. In another preferred embodiment the multicomponent refrigerant fluid consists solely of fluorocarbons and atmospheric gases. In another preferred embodiment the multicomponent refrigerant fluid consists solely of fluorocarbons, hydrofluorocarbons and fluoroethers. In another preferred embodiment the multicomponent refrigerant fluid consists solely of fluorocarbons, fluoroethers and atmospheric gases.

The multicomponent refrigerant fluid useful in the practice of this invention may contain other components such as hydrochlorofluorocarbons and/or hydrocarbons. Preferably, the multicomponent refrigerant fluid contains no hydrochlorofluorocarbons. In another preferred embodiment of the invention the multicomponent refrigerant fluid contains no hydrocarbons. Most preferably the multicomponent refrigerant fluid contains neither hydrochlorofluorocarbons nor hydrocarbons. Most preferably the multicomponent refrigerant fluid is non-toxic, non-flammable and non-ozone-depleting and most preferably every component of the multicomponent refrigerant fluid is either a fluorocarbon, hydrofluorocarbon, fluoroether or atmospheric gas.

The invention is particularly advantageous for use in efficiently reaching cryogenic temperatures from ambient temperatures. Tables 1–5 list preferred examples of multicomponent refrigerant fluid mixtures useful in the practice of this invention. The concentration ranges given in the Tables are in mole percent.

TABLE 1

| COMPONENT | CONCENTRATION RANGE |
|---|---|
| $C_5F_{12}$ | 5–25 |
| $C_4F_{10}$ | 0–15 |
| $C_3F_8$ | 10–40 |
| $C_2F_6$ | 0–30 |
| $CF_4$ | 10–50 |
| Ar | 0–40 |
| $N_2$ | 10–80 |

TABLE 2

| COMPONENT | CONCENTRATION RANGE |
|---|---|
| $C_3H_3F_5$ | 5–25 |
| $C_4F_{10}$ | 0–15 |

TABLE 2-continued

| COMPONENT | CONCENTRATION RANGE |
|---|---|
| $C_3F_8$ | 10–40 |
| $CHF_3$ | 0–30 |
| $CF_4$ | 10–50 |
| Ar | 0–40 |
| $N_2$ | 10–80 |

TABLE 3

| COMPONENT | CONCENTRATION RANGE |
|---|---|
| $C_3H_3F_5$ | 5–25 |
| $C_3H_3F_6$ | 0–15 |
| $C_2H_2F_4$ | 0–20 |
| $C_2HF_5$ | 5–20 |
| $C_2F_6$ | 0–30 |
| $CF_4$ | 10–50 |
| Ar | 0–40 |
| $N_2$ | 10–80 |

TABLE 4

| COMPONENT | CONCENTRATION RANGE |
|---|---|
| $CHF_2$—O—$C_2HF_4$ | 5–25 |
| $C_4H_{10}$ | 0–15 |
| $CF_3$—O—$CHF_2$ | 10–40 |
| $CF_3$—O—$CF_3$ | 0–20 |
| $C_2F_6$ | 0–30 |
| $CF_4$ | 10–50 |
| Ar | 0–40 |
| $N_2$ | 10–80 |

TABLE 5

| COMPONENT | CONCENTRATION RANGE |
|---|---|
| $C_3H_3F_5$ | 5–25 |
| $C_3H_2F_6$ | 0–15 |
| $CF_3$—O—$CHF_2$ | 10–40 |
| $CHF_3$ | 0–30 |
| $CF_4$ | 0–25 |
| Ar | 0–40 |
| $N_2$ | 10–80 |

The invention is especially useful for providing refrigeration over a wide temperature range, particularly one which encompasses cryogenic temperatures. In a preferred embodiment of the invention each of the two or more components of the refrigerant mixture has a normal boiling point which differs by at least 5 degrees Kelvin, more preferably by at least 10 degrees Kelvin, and most preferably by at least 20 degrees Kelvin, from the normal boiling point of every other component in that refrigerant mixture. This enhances the effectiveness of providing refrigeration over a wide temperature range, particularly one which encompasses cryogenic temperatures. In a particularly preferred embodiment of the invention, the normal boiling point of the highest boiling component of the multicomponent refrigerant fluid is at least 50° K., preferably at least 100° K., most preferably at least 200° K., greater than the normal boiling point of the lowest boiling component of the multicomponent refrigerant fluid.

Although the multicomponent refrigerant fluid flow circuit illustrated in the Drawing is a closed loop single flow circuit, it may be desirable to utilize other flow arrangements for specific applications. For example, it may be desirable to use multiple independent flow circuits, each with its own refrigerant mixture and process conditions. Such multiple circuits could more readily provide refrigeration at different temperature ranges and reduce refrigerant system complexity. Also, it may be desirable to include phase separations in the flow circuit at one or more temperatures to allow internal recycle of some of the refrigerant liquid. Such internal recycle of the refrigerant liquid would avoid unnecessary cooling of the refrigerant liquid and prevent refrigerant liquid freezing.

The components and their concentrations which make up the multicomponent refrigerant fluid useful in the practice of this invention are such as to form a variable load multicomponent refrigerant fluid and preferably maintain such a variable load characteristic throughout the whole temperature range of the method of the invention. This markedly enhances the efficiency with which the refrigeration can be generated and utilized over such a wide temperature range. The defined preferred group of components has an added benefit in that they can be used to form fluid mixtures which are non-toxic, non-flammable and low or non-ozone-depleting. This provides additional advantages over conventional refrigerants which typically are toxic, flammable and/or ozone-depleting.

One preferred variable load multicomponent refrigerant fluid useful in the practice of this invention which is non-toxic, non-flammable and non-ozone-depleting comprises two or more components from the group consisting of $C_5F_{12}$, $CHF_2$—O—$C_2HF_4$, $C_4HF_9$, $C_3H_3F_5$, $C_2F_5$—O—$CH_2F$, $C_3H_2F_6$, $CHF_2$—O—$CHF_2$, $C_4F_{10}$, $CF_3$—O—$C_2H_2F_3$, $C_3HF_7$, $CH_2F$—O—$CF_3$, $C_2H_2F_4$, $CHF_2$—O—$CF_3$, $C_3F_8$, $C_2HF_5$ $_{CF3}$—O—$CF_3$, $C_2F_6$, $CHF_3$, $CF_4$, $O_2$, Ar, $N_2$, Ne and He.

Although the invention has been described in detail with reference to a certain preferred embodiment, those skilled in the art will recognize that there are other embodiments of the invention within the spirit and the scope of the claims. For example, the invention may be practiced in conjunction with other cryogenic air separation systems and with other cryogenic separation systems such as natural gas upgrading and hydrogen or helium recovery. It may also be used for carrying out non-cryogenic subambient temperature separations such as carbon dioxide recovery.

What is claimed is:

1. A method for separating a fluid mixture comprising:

(A) compressing a multicomponent refrigerant fluid;

(B) cooling the compressed multicomponent refrigerant fluid to at least partially condense the multicomponent refrigerant fluid;

(C) expanding the cooled, compressed multicomponent refrigerant fluid to generate refrigeration;

(D) employing said refrigeration to maintain low temperature conditions for a fluid mixture;

(E) separating the fluid mixture into at least one more volatile vapor component and into at least one less volatile liquid component; and (F) recovering at least one of said more volatile vapor component(s) and less volatile liquid component(s).

2. The method of claim 1 wherein the separation of the fluid mixture is carried out in a cryogenic rectification plant.

3. The method of claim 1 wherein the expansion of the cooled, compressed multicomponent refrigerant fluid produces a two-phase multicomponent refrigerant fluid.

4. The method of claim 1 wherein the compression, cooling and expansion of the multicomponent refrigerant fluid is carried out in a closed loop.

5. The method of claim 1 wherein the multicomponent refrigerant fluid comprises at least two components from the group consisting of fluorocarbons, hydrofluorocarbons and fluoroethers.

6. The method of claim 1 wherein the multicomponent refrigerant fluid comprises at least one component from the group consisting of fluorocarbons, hydrofluorocarbons and fluoroethers and at least one atmospheric gas.

7. The method of claim 1 wherein the multicomponent refrigerant fluid comprises at least two components from the group consisting of fluorocarbons, hydrofluorocarbons and fluoroethers and at least two atmospheric gases.

8. The method of claim 1 wherein the multicomponent refrigerant fluid comprises at least one fluoroether and at least one component from the group consisting of fluorocarbons, hydrofluorocarbons, fluoroethers and atmospheric gases.

9. The method of claim 1 wherein each of the components of the multicomponent refrigerant fluid has a normal boiling point which differs by at least 5 degrees Kelvin from the normal boiling point of each of the other components of the multicomponent refrigerant fluid.

10. The method of claim 1 wherein the normal boiling point of the highest boiling component of the multicomponent refrigerant fluid is at least 50° K. greater than the normal boiling point of the lowest boiling component of the multicomponent refrigerant fluid.

11. The method of claim 1 wherein the multicomponent refrigerant fluid comprises at least two components from the group consisting of $C_5F_{12}$, $CHF_2—O—C_2HF_4$, $C_4HF_9$, $C_3H_3F_5$, $C_2F_5—O—CH_2F$, $C_3H_2F_6$, $CHF_2—O—CHF_2$, $C_4F_{10}$, $CF_3—O—C_2H_2F_3$, $C_3HF_7$, $CH_2F—O—CF_3$, $C_2H_2F_4$, $CHF_2—O—CF_3$, $C_3F_8$, $C_2HF_5$, $CF_3—O—CF_3$, $C_2F_6$, $CHF_3$, $CF_4$, $O_2$, Ar, $N_2$, Ne and He.

12. The method of claim 1 wherein the multicomponent refrigerant fluid is a variable load multicomponent refrigerant fluid throughout the whole temperature range of the method.

13. A method for carrying out cryogenic rectification of feed air comprising:

(A) passing feed air into a cryogenic rectification plant and separating the feed air by cryogenic rectification within the cryogenic rectification plant to produce at least one of product nitrogen and product oxygen;

(B) compressing a multicomponent refrigerant fluid, cooling the compressed multicomponent refrigerant fluid to at least partially condense the multicomponent refrigerant fluid, expanding the cooled, compressed multicomponent refrigerant fluid to generate refrigeration, and employing said refrigeration to sustain said cryogenic rectification; and (C) recovering at least one of product nitrogen and product oxygen from the cryogenic rectification plant.

14. The method of claim 13 wherein the refrigeration generated by the expansion of the multicomponent refrigerant fluid is the only refrigeration employed to sustain the cryogenic rectification.

15. The method of claim 13 wherein the compression, cooling and expansion of the multicomponent refrigerant fluid is carried out in a closed loop.

* * * * *